United States Patent [19]

Parmer

[11] Patent Number: 4,464,007

[45] Date of Patent: Aug. 7, 1984

[54] PIN TERMINAL MOUNTING SYSTEM

[75] Inventor: Kenneth R. Parmer, Harrisburg, Pa.

[73] Assignee: AMP Incorporated, Harrisburg, Pa.

[21] Appl. No.: 382,001

[22] Filed: May 25, 1982

[51] Int. Cl.[3] ..... H01R 4/24

[52] U.S. Cl. ..... 339/220 T; 339/221 M; 339/252 P

[58] Field of Search ..... 339/220 R, 220 T, 221 R, 339/221 M, 17 C, 252 P

[56] References Cited

U.S. PATENT DOCUMENTS

| | | | |
|---|---|---|---|
| 2,994,056 | 7/1961 | Fox | 339/220 R |
| 3,444,504 | 5/1969 | Lynch et al. | 339/64 |
| 3,523,273 | 8/1970 | Hammell et al. | 339/64 |
| 3,530,422 | 9/1970 | Goodman | 339/220 T |
| 3,545,606 | 12/1970 | Bennett | 206/56 |
| 3,634,819 | 1/1972 | Evans | 339/252 P |
| 3,761,871 | 9/1973 | Teurlings | 339/221 R |
| 3,780,433 | 12/1973 | Lynch | 339/17 C |
| 4,186,982 | 2/1980 | Cobaugh et al. | 339/221 M |
| 4,274,700 | 6/1981 | Keglewitsch et al. | 339/221 M |

FOREIGN PATENT DOCUMENTS

| | | | |
|---|---|---|---|
| 1060271 | 3/1967 | United Kingdom | 339/221 R |

*Primary Examiner*—John McQuade
*Assistant Examiner*—Paula Austin
*Attorney, Agent, or Firm*—Russell J. Egan; Allen B. Osborne

[57] ABSTRACT

An improved pin terminal configuration obviates bowing and cracking of associate housings which often occurs with force fit insertion of standard pin terminals. The subject pin terminals are formed in pairs having compatible intermediate mounting portions with profiled enlargements and recesses which allow for corresponding displacement of and reception of housing material flowing as a result of the insertion process. The intermediate mounting portions are so spaced on the respective pin terminals as to lie substantially centrally of the thickness of the associate housing.

6 Claims, 4 Drawing Figures

PIN TERMINAL MOUNTING SYSTEM

The present invention relates to a method and means for mounting a plurality of pin terminals in a connector block in a closely spaced array without incurring damage to the connector block.

There is an increasing requirement to have electrical interconnections in higher density configurations. This higher density of components causes an increasing strain upon the materials, in particular the plastics materials used for many electrical connector housings. Under many circumstances, high density configurations of pin terminals in plastic terminal blocks can result in either cracking or total breakdown of the terminal block or the equally undesirable deformation and/or distortion of the terminal block which could throw the pin terminals out of alignment. The former situation clearly would result in a failure mode. The latter situation may not be quite as acute still could cause problems in obstructing intermateability, damage to the terminals, higher mating forces, and greater terminal wear.

Heretofore, pin terminals have been staked into plastic housings with little or no thought given to the consequences of such action which could cause some problems. The main considerations have been getting the terminals at the correct location with sufficient stability to be relatively rigid in the housing block. However, the higher densities currently required raise the above-mentioned further considerations of housing block failure.

The present invention is characterized by a high density array of pin terminals which are stamped and formed as a continuous series of compatible adjacent pairs of pin terminals. Each pair of pin terminals has oppositely directed first and second mating ends and an intermediate retention area so designed so that first and second areas on a first pin terminal of the pair are equal to a third area on a second pin terminal of the pair with the two areas of the first pin terminal being equal distance from the centerline of the housing base and the area of the third area of the second pin terminal being centered on the centerline of the housing base so as to allow limited flow of housing material into the offset recessed areas of the compatible pin terminal.

The present invention will be described by way of example with reference to the accompanying figures in which.

Figure 4:
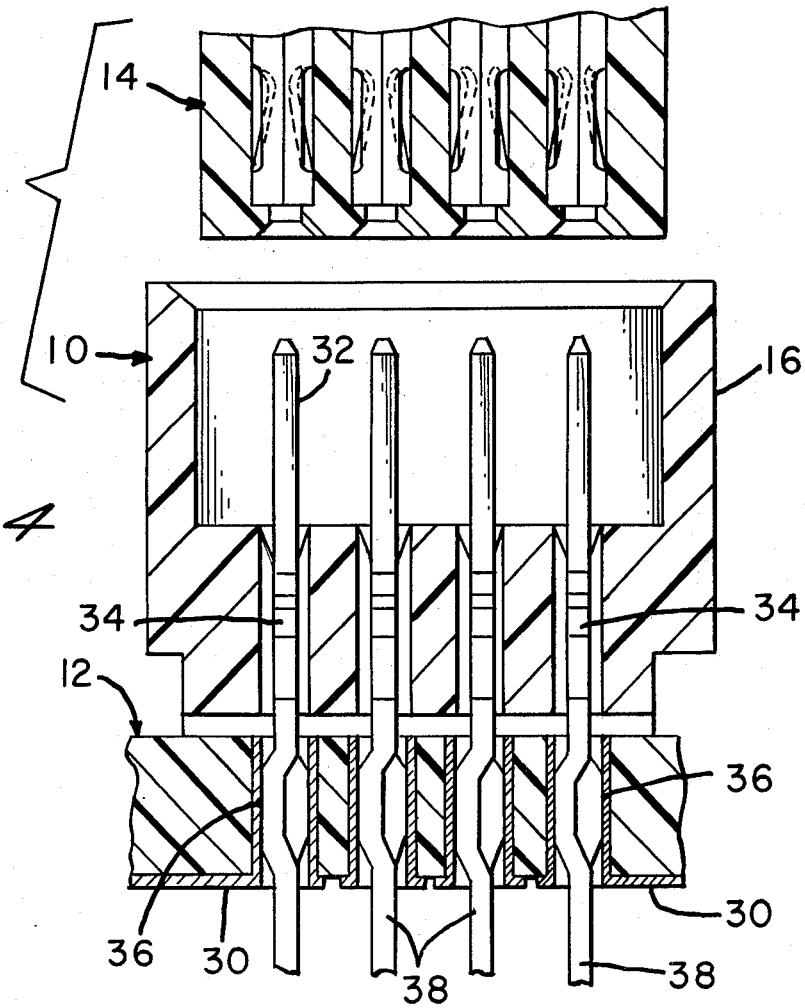
FIG. 4 is a transverse section taken along line 4—4 of FIG. 1.

The present invention concerns a pin header 10 which is used to make electrical and mechanical interconnection between a circuit board 12 and an electrical connector socket 14 (see FIG. 4) terminating multiple conductors (not shown).

The pin header 10 is of a fairly conventional type, It has a housing 16 molded out of one piece of rather rigid plastic material and has a first surface 18 defining a connector receiving cavity 20 and an oppositely directed face 22 for mounting the header 10 on a circuit board 12 or the like. The header 10 further can be provided with either mounting means (not shown) or means such as profiled apertures 24 which accept such mounting means. A plurality of pin terminals 26 are staked in a base 28 of the cavity 20 in a high density array. The pin terminals 26 are used to make an interconnection between an electrical connector 14 that is profiled to be recieved in the cavity 20 and pads 30 of the circuit board 12.

Each pin terminal 20 has a first mating end 32 lying in the cavity 20, an intermediate retention portion 34, a board mounting portion 36, and a second oppositely directing mating end 38. The board mounting portion 36 is preferably a compliant section of the type disclosed in U.S. Pat. No. 4,186,982, the disclosure of which is incorporated herein by reference. The second mating end 38 can be used to receive a second connector (not shown), terminal clips (also not shown) or the like. The terminal pins 26 are formed in pairs of pin terminals A and B with the retention area 34 on the A pin having a pair of spaced enlargements 40, 42 which are equal distance from the centerline 44 of the housing base 28 and within the retention area 34, while the terminal B has a single enlargement 46 which is centered on the centerline 44 of the housing base 28 and the retention area 34. Each pin terminal is further provided with a shoulder 48 which receives the staking force.

Figure 1:
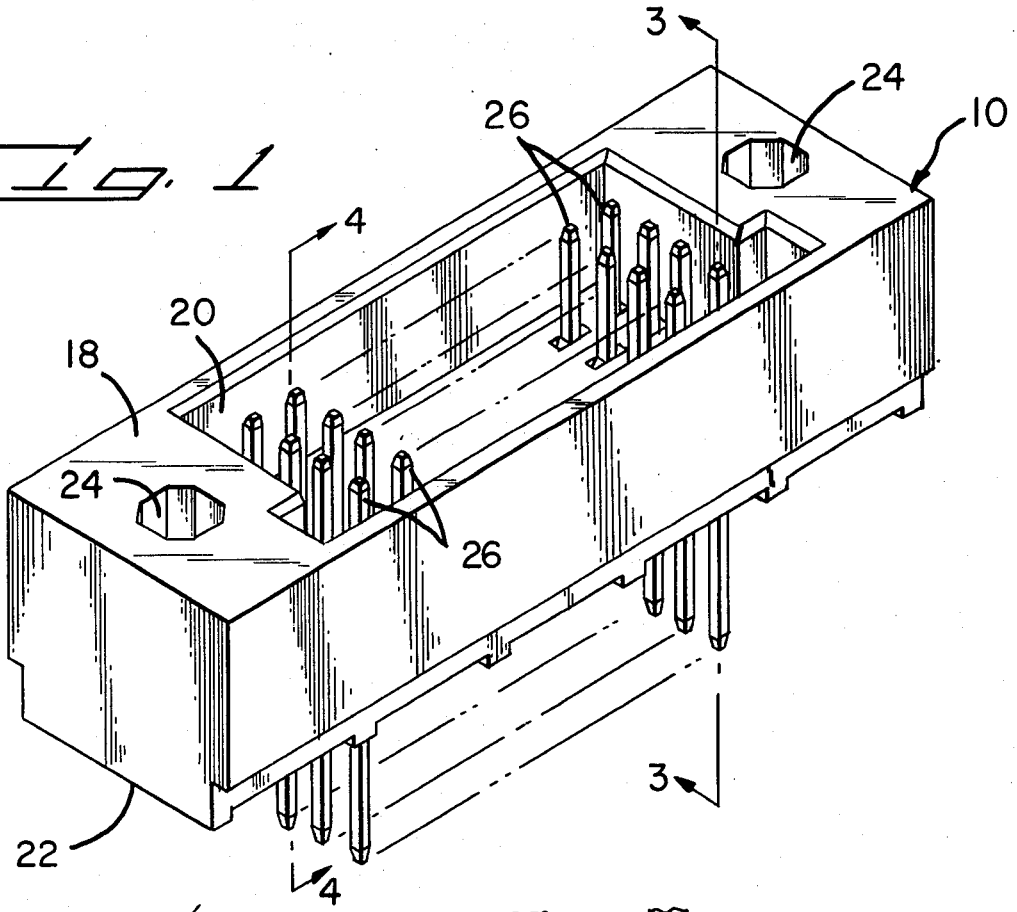
FIG. 1 is a perspective view of a pin header incorporating pin terminals according to the present invention.
Figure 2:
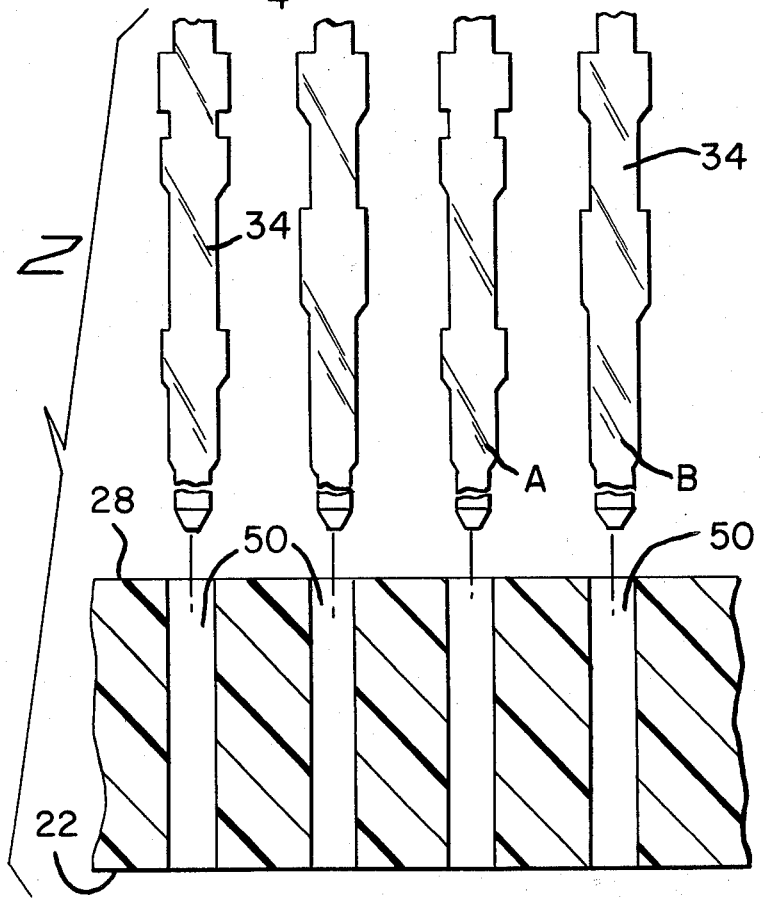
FIG. 2 is a side elevation, partially in section, showing pin terminals according to the present invention exploded from a segment of a pin header.
Figure 3:
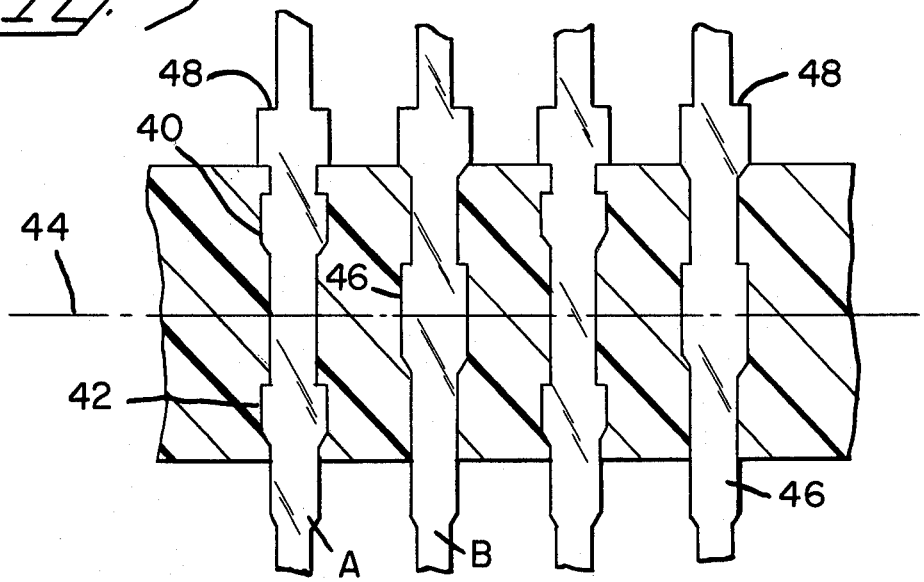
FIG. 3 is a partial longitudinal section taken along line 3—3 of FIG. 1.

This invention can best be appreciated from FIGS. 2 and 3, and in particular to FIG. 3. The passages 50 have a smaller cross section than the pin terminals 26 so that there will be an interference fit assuring fixed retention of the pin terminals 26 in the header 10. When the pin terminals 26 A and B are inserted into adjacent passages 50 in the base 28 there will be some flow of the housing material. With conventional pin terminals there would be no provision to accommodate this flow. In the present instance, the material forced to flow by engagement 46 of a B terminal will be received between the enlargements 40, 42 of the adjacent A terminals. Likewise the material forced to flow by the enlargements 40, 42 of an A terminal will be received on both sides of the enlargement 46 of adjacent B terminals. Thus, the material which is forced to flow need not move far and will be accommodated thereby substantially eliminating bowing and cracking of the header due to pin terminal insertion.

I claim:

1. A pin header having a housing of insulative material having first and second oppositely directed faces, a cavity formed in one of said faces defining a thin base, a plurality of pin apertures in said base extending between said cavity and the other of said faces, a plurality of pin terminals mounted in respective pin apertures of said header, each said pin terminal having a first mating portion lying in said cavity, a second mating portion extending beyond said other face, a board mounting portion in said second mating portion, and a retention portion lying within said aperture, said pin terminals being formed in a series of cooperating pairs of terminals, characterized by the first of each pair of pin terminals having a retention portion defining pairs of transverse enlargements equal distance from a centerline of the header base and the second of each pair of said pin terminals having a single transverse enlargement centered on said centerline of the header base so that material displaced by the pair of enlargements of the first of each pair of pin terminals flows above and below the single enlargement of the adjacent second of each pair of pin terminals while the material displaced by the single enlargement enters the area between the enlargements of the first pin terminal.

2. A pin header according to claim 1 further comprising:

at least one shoulder on said first mating portion adjacent said retention portion whereby staking forces are applied to said pin terminals.

3. A pin header according to claim 1 wherein said board mounting portion is a compliant section for solderless mounting in a circuit board.

4. Pin terminals for mounting in high density applications, said pin terminals formed in a continuous array of pairs comprising:

a plurality of pairs of pin terminals stamped from a web of conductive stock, each pin terminal of each said pair of terminals, having first and second oppositely directed mating portions and an intermediate retention portion, characterized by the first of each pair of pin terminals having a pair of transverse enlargements equal distance from a centerline of the retention portion and the second of said pair of pin terminals having a single transverse enlargement centered on the centerline of said retention portion so that plastic material of an associate housing displaced by the pair of enlargements flows above and below the single enlargement of the adjacent pin terminal while the plastic material of said associate housing displaced by the single enlargement enters the area between the enlargements of the first pin terminal whereby overstressing and cracking of the housing are obviated.

5. Pin terminals according to claim 4 further comprising at least one shoulder on each pin terminal adjacent said retention portion against which a staking force is applied.

6. Pin terminals according to claim 4 further comprising a compliant mounting section adjacent said intermediate retention portion whereby said terminals can be mounted in a circuit board in a solderless fashion.

* * * * *